US006834643B2

(12) United States Patent
Hori et al.

(10) Patent No.: US 6,834,643 B2
(45) Date of Patent: Dec. 28, 2004

(54) BREATHER STRUCTURE OF OVERHEAD-VALVE INTERNAL COMBUSTION ENGINE

(75) Inventors: Yoshiaki Hori, Saitama (JP); Kinya Mizuno, Saitama (JP); Hideyuki Tawara, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/679,453

(22) Filed: Oct. 7, 2003

(65) Prior Publication Data

US 2004/0149242 A1 Aug. 5, 2004

(30) Foreign Application Priority Data

Oct. 9, 2002 (JP) ..... 2002-295952

(51) Int. Cl.[7] ..... F01M 13/04
(52) U.S. Cl. ..... 123/572; 123/573
(58) Field of Search ..... 123/572–574, 123/41.86

(56) References Cited

U.S. PATENT DOCUMENTS 5,664,549 A * 9/1997 Hutchins ..... 123/572
6,334,438 B1 * 1/2002 Itoh et al. ..... 123/572
6,508,238 B2 * 1/2003 Furuya ..... 123/572
6,598,595 B2 * 7/2003 Yasui ..... 123/572

FOREIGN PATENT DOCUMENTS

JP 2000-220435 A 8/2000

* cited by examiner

*Primary Examiner*—Marguerite McMahon
(74) *Attorney, Agent, or Firm*—Birch, Stewart, Kolasch & Birch, LLP

(57) ABSTRACT

An overhead-valve internal combustion engine with a breather chamber arranged below a camshaft housing chamber for housing the camshaft and formed between a cylinder head and a cylinder block. A driving force transmission chamber is formed between a cylinder and a crankcase. Thus, the discharge of oil from the breather chamber is performed smoothly so as to enhance the vapor-liquid separation performance. A breather inlet passage has an upper end thereof in communication with an inside of a camshaft housing chamber and a lower end thereof in communication with a breather chamber at a position corresponding to a mating face between a cylinder block and a crankcase is formed in the cylinder block such that the breather inlet passage extends vertically. An oil discharge hole is in communication with a lower portion of the inside of the breather chamber and is formed in the crankcase.

20 Claims, 5 Drawing Sheets

BREATHER STRUCTURE OF OVERHEAD-VALVE INTERNAL COMBUSTION ENGINE

CROSS-REFERENCE TO RELATED APPLICATIONS

The present application claims priority under 35 USC 119 to Japanese Patent Application No. 2002-295952 filed on Oct. 9, 2002 the entire contents thereof are hereby incorporated by reference.

BACKGROUND OF THE INVENTION

1. Field of the Invention

The present invention relates to a breather structure of an overhead-valve internal combustion engine, and more particularly to an improvement of a breather structure of an overhead-valve internal combustion engine in which a cylinder bore is formed in a cylinder block coupled to a crankcase which rotatably supports a crankshaft. A camshaft housing chamber, which houses a camshaft for performing open/close driving of an intake valve and an exhaust valve which are arranged in a cylinder head, is formed between the cylinder head which is coupled to the cylinder block. A driving force transmission chamber, which is arranged at the side of the cylinder bore is formed in the crankcase, the cylinder block and the cylinder head such that a driving force transmission member which transmits a rotational driving force of the crankshaft to the camshaft is housed in the driving force transmission chamber. A breather chamber, which is arranged below the camshaft housing chamber and at the side of the cylinder bore and the driving force transmission chamber, is formed such that the breather chamber extends between the cylinder block and the crankcase.

2. Description of Background Art

A breather structure is known as set forth, for example, in Japanese Unexamined Patent Publication 2000-220435. In this breather structure, a communication hole which functions as a breather inlet hole for introducing a blowby gas into the breather chamber and also as an oil discharge hole for discharging oil from the breather chamber through a lower portion of the inside of the breather chamber is formed in the cylinder block to permit communication of the lower portion of the breather chamber with the driving force transmission chamber.

However, in the above-mentioned conventional breather structure, there exists a possibility that when the blowby gas is introduced into the breather chamber from the driving force transmission chamber through the communication hole. Thus, the blowby gas impedes the discharge of oil from the communication hole to the driving force transmission chamber. Further, since the communication hole is present at the lower position of the crankcase, there exists the possibility that the rich blowby gas in which an oil mist generated in the crankcase is mixed is introduced into the breather chamber. In this case, it is difficult to acquire an excellent vapor-liquid separation performance.

SUMMARY AND OBJECTS OF THE INVENTION

The present invention is made in view of such circumstances and it is an object of the present invention to provide a breather structure of an overhead-valve internal combustion engine which performs the discharge of oil from a breather chamber smoothly and, at the same time, enhances the vapor-liquid separation performance.

To achieve the above-mentioned object, the present invention is directed to a breather structure of an overhead-valve internal combustion engine in which a cylinder bore is formed in a cylinder block coupled to a crankcase which rotatably supports a crankshaft. A camshaft housing chamber, which houses a camshaft for performing open/close driving of an intake valve and an exhaust valve which are arranged in a cylinder head, is formed between the cylinder head which is coupled to the cylinder block and the cylinder block. A driving force transmission chamber which is arranged at the side of the cylinder bore is formed in the crankcase, the cylinder block and the cylinder head such that a driving force transmission member which transmits a rotational driving force of the crankshaft to the camshaft is housed in the driving force transmission chamber. A breather chamber, which is arranged below the camshaft housing chamber and at the side of the cylinder bore and the driving force transmission chamber, is formed such that the breather chamber extends between the cylinder block and the crankcase. A breather inlet passage is provided which has an upper end thereof in communication with the inside of the camshaft housing chamber and a lower end thereof in communication with the breather chamber at a position corresponding to a mating face between the cylinder block and the crankcase and is arranged in the cylinder block such that the breather inlet passage extends vertically, and an oil discharge hole which is in communication with a lower portion of the inside of the breather chamber is arranged in the crankcase.

According to the present invention, since the breather inlet passage and the oil discharge hole are arranged at positions which are spaced apart from each other, there is no possibility that the discharge of the oil from the breather chamber is impeded by the blowby gas introduced into the breather chamber whereby the oil can be smoothly discharged. Further, the blowby gas ascends up to the camshaft housing chamber from the inside of the crankcase through the driving force transmission chamber. Thereafter, the blowby gas reverses the flow direction thereof and descends to at least the crankcase side of the breather chamber. Hence, the concentration of oil mist in the blowby gas which is introduced into the breather chamber is lowered whereby the vapor-liquid separation performance is enhanced.

The present invention provides a projecting portion which projects upwardly from a lower face of the camshaft housing chamber that is integrally formed on an upper portion of the cylinder block. The upper end of the breather inlet passage opens at an upper end of the projecting portion. Due to such a constitution, the oil which stays at the lower portion in the inside of the camshaft housing chamber is prevented from being introduced into the breather chamber through the breather inlet passage.

The present invention provides a cylinder gasket which partitions the breather chamber into a lower chamber at the crankcase side and an upper chamber at the cylinder block side to allows the flow of a blowby gas from the lower chamber to the upper chamber. The present invention is capable of separating a vapor-liquid mixture from the blowby gas inserted between the crankcase and the cylinder block. A communication hole is provided which allows a lower end of the breather inlet passage to communicate with the lower chamber that is formed in the cylinder gasket. Due to such a constitution, the blowby gas which is introduced to the breather chamber from the breather inlet passage is made to flow into the upper chamber from the lower chamber through the cylinder gasket. Furthermore, the cylinder gasket has a gas-liquid separation function and hence, it is possible to enhance the vapor-liquid performance without using special members.

The present invention provides a large number of small holes which make the lower chamber and the upper chamber communicate with each other that are formed in the cylinder gasket. Due to such a constitution, it is possible to efficiently perform the vapor-liquid separation with a simple structure.

Further, the present invention provides an oil discharge passage which is in communication with the oil discharge hole that has a lower end thereof in communication with the inside of the crankcase below an oil surface in the inside of the crankcase. Due to such a constitution, it is possible to prevent the rich blowby gas containing an oil mist generated in the inside of the crankcase from inversely flowing into the breather chamber from the oil discharge passage. At the same time, it is possible to ensure a return of the oil separated in the breather chamber to a lower portion of the inside of the crankcase.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The mode for carrying out the present invention is explained based on one embodiment of the present invention shown in attached drawings.

Figure 1:
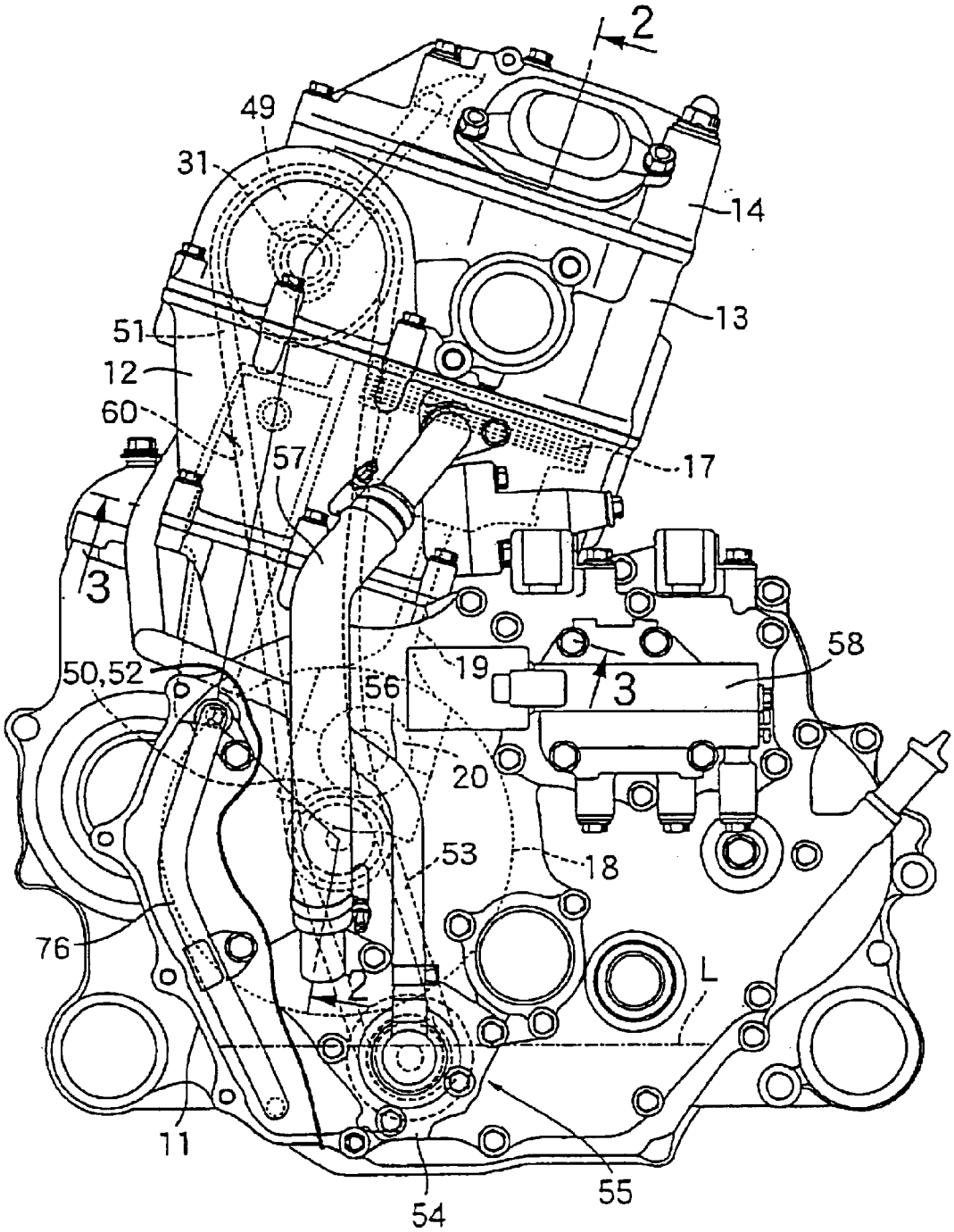
FIG. 1 is a side view with a part broken away of an overhead-valve internal combustion engine.

First of all, in FIG. 1, the overhead-valve internal combustion engine includes a single cylinder four-cycle water-cooled engine having four overhead valves and is, for example, mounted on a vehicle such as a saddle-ride type vehicle. The overhead-valve internal combustion engine includes a crankcase 1, a cylinder block 12 which is connected to an upper portion of the crankcase 11, a cylinder head 13 which is coupled to an upper portion of the cylinder block 12, and a head cover 14 which is coupled to an upper portion of the cylinder head 13.

Figure 2:
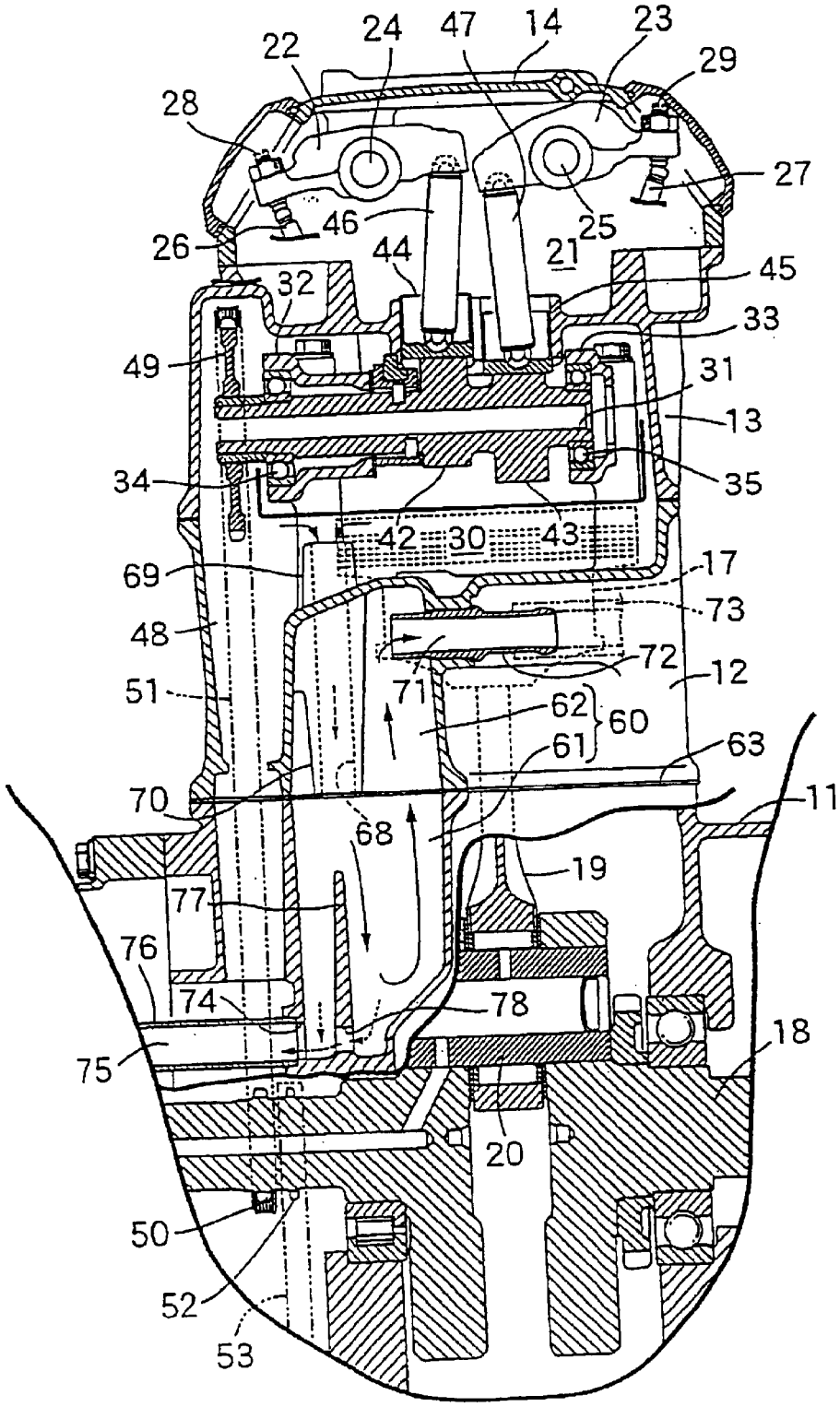
FIG. 2 is a cross-sectional view taken along a line 2—2 in FIG. 1.
Figure 3:
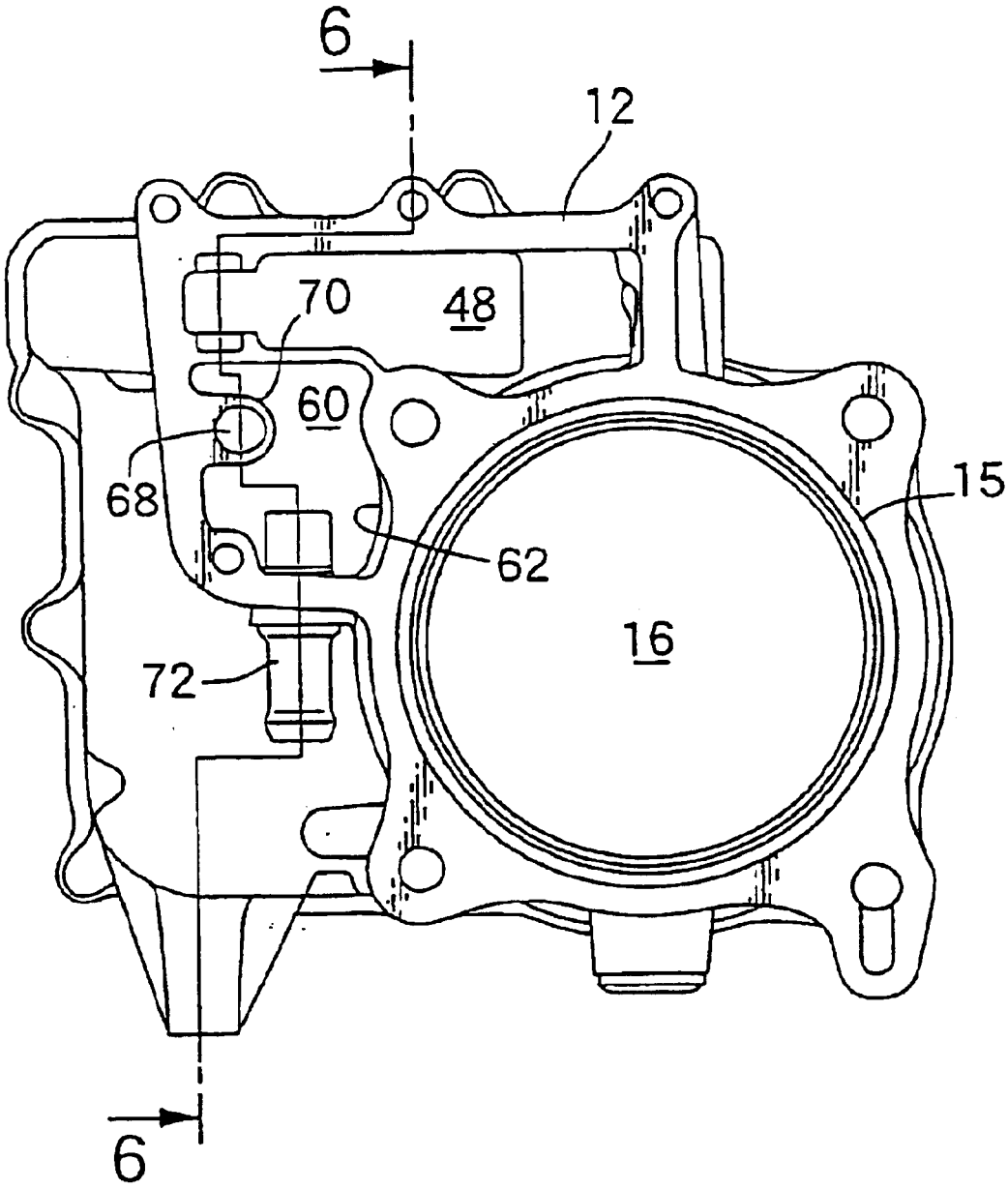
FIG. 3 is a bottom view of a cylinder block as viewed in an arrow direction from a line 3—3 in FIG. 1.

Further by reference to FIG. 2 and FIG. 3, a cylindrical liner 15 which has a portion thereof projecting from a lower portion of the cylinder block 12 is integrally formed with the cylinder block 12 by casting, while a cylinder bore 16 is formed in the inside of the liner 15. Further, the projecting portion of the liner 15 from the cylinder block 12 projects into the crankcase 11 side when the crankcase 11 and the cylinder block 12 are connected to each other.

A piston 17 is slidably fitted in the cylinder bore 16 and this piston 17 is connected to a crankshaft 18 which, for example, has an axis extending in the fore-and-aft direction of the vehicle and is rotatably supported on the crankcase 11 by way of a connecting rod 19 and a crankpin 20.

A rocker arm housing chamber 21 is formed between the cylinder head 13 and the head cover 14. An intake-side rocker arm 22 and an exhaust-side rocker arm 23 are respectively tiltably housed in the rocker arm housing chamber 21. That is, intake-side and exhaust-side rocker shafts 24, 25 which respectively have axes orthogonal to a plane including an axis of the crankshaft 18 and an axis of the cylinder bore 16 are supported on the head cover 14. Intermediate portions of the intake-side and exhaust-side rocker arms 22, 23 are respectively tiltably supported on the intake-side and exhaust-side rocker shafts 24, 25.

On the other hand, two sets each consisting of a pair of intake valve 26 and an exhaust valve 27 which are respectively biased in the valve closing direction are arranged in the cylinder head 13 such that these valves can be opened and closed. A pair of tappet screws 28 which are threaded into one end portion of the intake-side rocker arm 22 are respectively brought into contact with upper ends of both intake valves 26, while a pair of tappet screws 29 which are threaded into one end portion of the exhaust-side rocker arm 23 are respectively brought into contact with upper ends of both exhaust valves 27.

Figure 4:
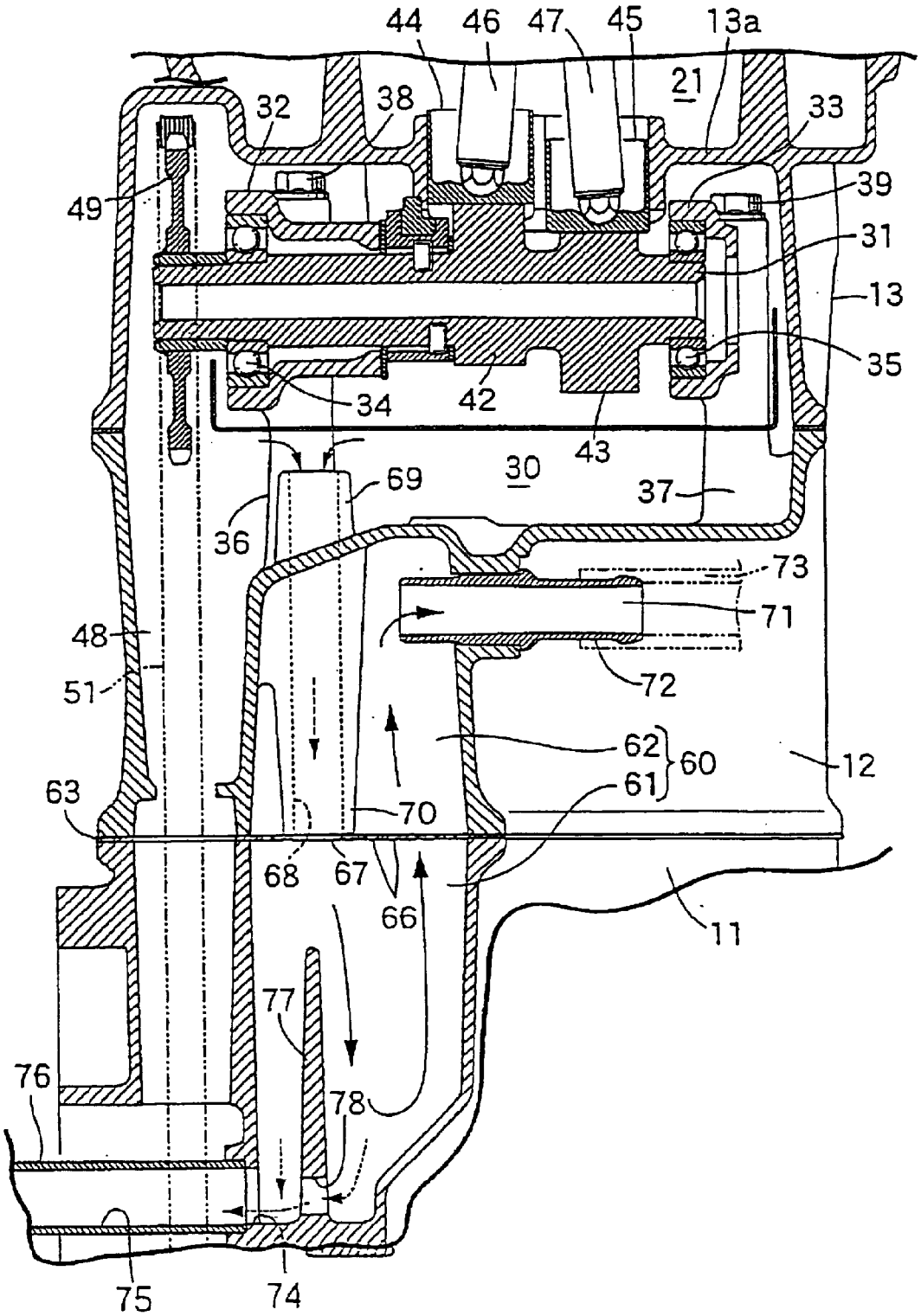
FIG. 4 is an enlarged view of an essential part in FIG. 2.

Further by reference to FIG. 4, a camshaft housing chamber 30 which is positioned below the rocker arm housing chamber 21 is provided between the cylinder block 12 and the cylinder head 13. A camshaft 31 which has an axis parallel to the crankshaft 18 is housed in the camshaft housing chamber 30.

The camshaft 31 is rotatably supported on cam holders 32, 33 which are arranged at two positions spaced apart in the axial direction of the camshaft 31 by way of ball bearings 34, 35. Both cam holders 32, 33 are fastened to support bosses 36, 37 which are integrally mounted on an upper portion of the cylinder block 12 in a projecting manner by means of bolts 38, 39.

An intake-side cam 42 and an exhaust-side cam 43 are integrally formed on the camshaft 31 between both cam holders 32, 33. In a wall portion 13*a* of the cylinder head 13 which partitions the rocker arm housing chamber 21 and the camshaft housing chamber 30, an intake-side lifter 44 which follows the movement of the intake-side cam 42 and an exhaust-side lifter 45 which follows the movement of the exhaust-side cam 43 are fitted such that the lifters 44, 45 are vertically slidable.

Further, between another end portions of the intake-side lifter 44 and the intake-side rocker arm 22, there is provided a rod 46 for tiltably driving the intake-side rocker arm 22 in response to the vertical slide movement of the intake-side lifter 44 which is brought about by the rotation of the intake-side cam 42. Further, between another end portions of the exhaust-side lifter 45 and the exhaust-side rocker arm 23, there is provided a rod 47 for tiltably driving the exhaust-side rocker arm 23 in response to the vertical slide movement of the exhaust-side lifter 45 which is brought about by the rotation of the exhaust-side cam 43. Due to such a constitution, in response to the rotation of the camshaft 31, both of intake valves 26 and both of exhaust valves 27 are subjected to an open/close driving with open/close characteristics corresponding to cam profiles of the intake-side cam 42 and the exhaust-side cam 43.

One end portion of the camshaft 31 projects from one of both cam holders 32, 33 and is arranged at an upper portion of the inside of the driving force transmission chamber 48. The driving force transmission chamber 48 is formed in the crankcase 11, the cylinder block 12 and the cylinder head 13 such that the driving force transmission chamber 48 is arranged along the side of the cylinder bore 16.

In the inside of the driving force transmission chamber 48, a driven sprocket wheel 49 is fixed to one end portion of the camshaft 31, while a first driving sprocket wheel 50 is integrally formed on the crankshaft 18. Here, the cam chain 51 which is housed in the driving force transmission chamber 48 is wound around the first driving sprocket wheel 50 and the driven sprocket wheel 49 so that a rotational force of the crankshaft 18 is reduced to ½ in speed and is transmitted to the camshaft 31.

Further, at a position close to the first driving sprocket 50, a second driving sprocket wheel 52 is integrally formed on the crankshaft 18. With the use of an endless chain 53 wound around the second driving sprocket 52, as shown in FIG. 1, to a cooling water pump 55 whose pump casing 54 is fastened to an outer side face of the crankcase 11, the rotational force of the crankshaft 18 is transmitted. The cooling water pump 55 is provided for circulating cooling water in a cooling water jacket (not shown in the drawing) formed on the cylinder block 12 and the cylinder head 13. The cooling water pump 55 has an intake passage 56 and a discharge passage 57 thereof connected to the pump casing 54.

Here, a hydraulic automatic transmission (not shown in the drawing) is incorporated in the inside of the crankcase 11 and a control valve 58 for controlling the speed-change operation of the automatic transmission is mounted on an outer side face of the crankcase 11.

A breather chamber 60 which is arranged below the camshaft housing chamber 30 and at the side of the cylinder bore 16 and the driving force transmission chamber 48 is formed such that the breather chamber 60 extends between the cylinder block 12 and the crankcase 11.

Figure 5:
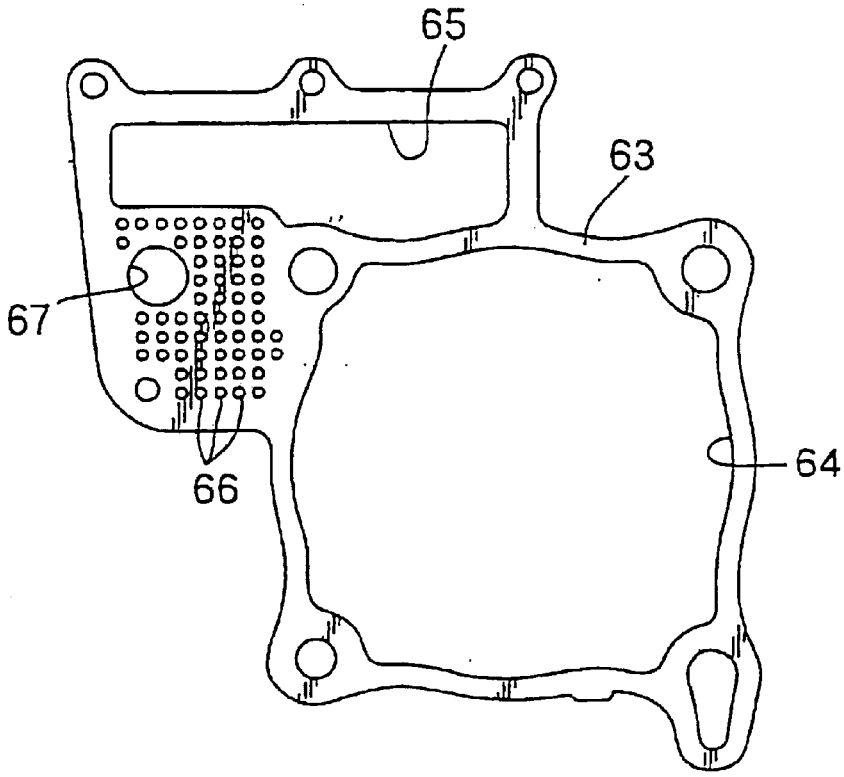
FIG. 5 is a bottom view of a cylinder gasket.

Further by reference to FIG. 5, between the crankcase 11 and the cylinder block 12, a cylinder gasket 63 which has a first opening portion 64 which allows a liner 15 to pass therethrough and a second opening portion 65 corresponding to the driving force transmission chamber 48 is interposed. The breather chamber 60 is partitioned to form a lower chamber 61 at the crankcase 11 side and an upper chamber 62 at the cylinder block 12 side by the cylinder gasket 63.

Further, the cylinder gasket 63 is provided as means which can separate a vapor-liquid mixture from the blowby gas while allowing the flow of the blowby gas from the lower chamber 61 to the upper chamber 62. For this end, a large number of small holes 66, 66 which permit the lower chamber 61 and the upper chamber 62 to be in communication with each other are formed in the cylinder gasket 63.

Figure 6:
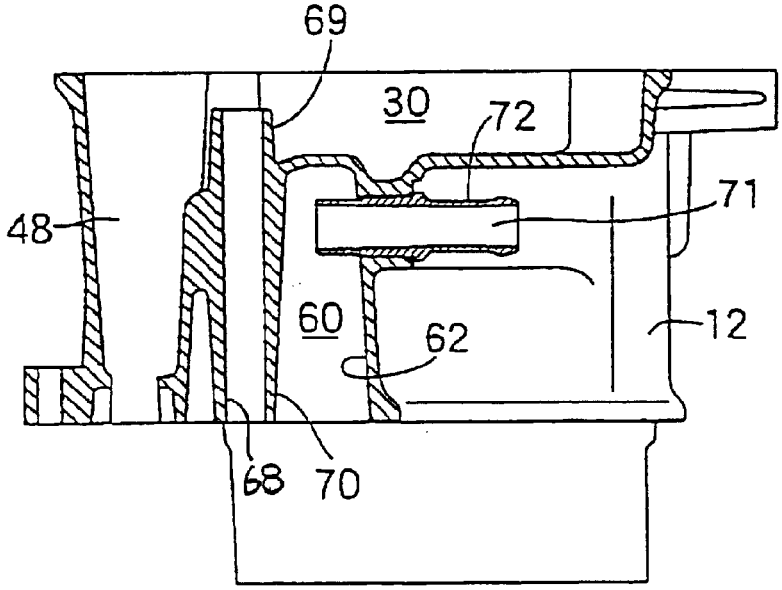
FIG. 6 is a cross-sectional view taken along a line 6—6 in FIG. 3.

Further by reference to FIG. 6, a breather inlet passage 68 which has an upper end thereof in communication with the inside of the camshaft housing chamber 30 and a lower end thereof in communication with the breather camber 60 at a position corresponding to a mating face between the cylinder block 12 and the crankcase 11 is formed in the cylinder block 12 such that the breather inlet passage 68 extends vertically.

Here, a projecting portion 69 which projects upwardly from a lower face of the camshaft housing chamber 30 is integrally formed on the upper portion of the cylinder block 12. At a position corresponding to the projecting portion 69, a projection 70 which projects inwardly from a side face of the upper chamber 62 and extends between both upper and lower ends of the upper chamber 62 is formed on the cylinder block 12. The breather inlet passage 68 is formed such that the breather inlet passage 68 extends vertically in the inside of the projecting portion 69 and the projection 70. That is, the upper end of the breather inlet passage 68 opens at an upper end of the projecting portion 69 and the lower end of the breather inlet passage 68 opens at the lower end of the projection 70. Further, in the cylinder gasket 63 which brings an upper face thereof into contact with the lower end of the projection 70, a communication hole 67 which permits the lower end of the breather inlet passage 68 to be in communication with the lower chamber 61 in the inside of the breather chamber 60 is formed.

Further, in the cylinder block 12, a connection tube 72 which defines a breather outlet passage 71 is pushed therein such that an inner end thereof is in communication with the upper portion of the upper chamber 62. Another end of a conduit 73 which has one end thereof in communication with an outer end of the connection pipe 72 is connected to an air cleaner not shown in the drawing.

An oil discharge hole 74 is formed in the crankcase 11 such that the oil discharge hole 74 is in communication with a lower portion in the inside of the lower chamber 61 at a side opposite to the breather outlet passage 71. An upper end and a lower end of a conduit 76, which defines an oil discharge passage 75, are in communication with the oil discharge hole 74 and are connected to the crankcase 11. Further, the lower end of the conduit 76 is connected to the lower portion of the crankcase 11 such that the lower end of the oil discharge passage 75 is in communication with the inside of the crankcase 11 below an oil surface L in the inside of the crankcase 11.

Further, in the crankcase 11, a partition wall 77 which faces the oil discharge hole 74 in an opposed manner is integrally formed in a projecting manner such that the partition wall 77 divides the lower portion in the inside of the lower chamber 61 into halves. The partition wall 77 is arranged at a position below the breather inlet passage 68 and close to the oil discharge hole 74 such that the partition wall 77 impedes the direct flow of the blowby gas introduced into the lower chamber 61 from the breather inlet passage 68 to the oil discharge hole 74 side. Further, a passage 78 which introduces oil separated from the blowby gas to the oil discharge hole 74 side is formed in a lower portion of the partition wall 77.

Next, to explain the manner of operation of this embodiment, the breather inlet passage 68, which has the upper end thereof in communication with the inside of the camshaft housing chamber 30 and the lower end thereof in communication with the breather chamber 60 at a position corresponding to the mating face between the cylinder block 12 and the crankcase 11, is formed in the cylinder block 12 such that the breather inlet passage 68 extends vertically. Since the oil discharge hole 74 which is in communication with the lower portion of the inside of the breather chamber 60 is formed in the crankcase 11, the breather inlet passage 68 and the oil discharge hole 74 are arranged at positions spaced apart from each other, whereby there is no possibility that the discharge of oil from the breather chamber 60 is impeded by the blowby gas introduced into the breather chamber 60 and the discharge of oil from the breather chamber 60 can be performed smoothly.

Further, the blowby gas ascends to the camshaft housing chamber 30 from the inside of the crankcase 11 through the driving force transmission chamber 48 and inverses the flow direction and descends at least to the crankcase 11 side of the breather chamber 60. Hence, the concentration of the oil mist in the blowby gas introduced into the breather chamber 60 is lowered whereby the vapor-liquid separation performance in the breather chamber 60 can be enhanced.

Further, the projecting portion 69 which projects upwardly from the lower face of the camshaft housing chamber 30 is integrally formed on the upper portion of the cylinder block 12 and the upper end of the breather inlet passage 68 opens at the upper end of the projecting portion 69. Hence, it is possible to prevent the oil dwelling in the lower portion of the inside of the camshaft housing chamber 30 from being introduced into the breather chamber 60 through the breather inlet passage 68.

Further, between the crankcase 11 and the cylinder block 12, a cylinder gasket 63 which divides the breather chamber 60 into the lower chamber 61 at the crankcase 11 side and the upper chamber 62 at the cylinder block 12 side and enables the separation of the vapor-liquid mixture from the blowby gas while allowing the communication of the blowby gas from the lower chamber 61 to the upper chamber 62 is interposed, and the communication hole 67 which makes the lower end of the breather inlet passage 68 communicate with the lower chamber 61 is formed in the cylinder gasket 63. Accordingly, the blowby gas which is introduced into the breather chamber 60 from the breather inlet passage 68 flows into the upper chamber 62 from the lower chamber 61 through the cylinder gasket 63, wherein the cylinder gasket 63 has the vapor-liquid separation function. Accordingly, it is possible to enhance the vapor-liquid separation performance without using special members.

Further, since a large number of small holes 66, 66 which make the lower chamber 61 and the upper chamber 62 communicate with each other are formed in the cylinder gasket 63, it is possible to perform the vapor-liquid separation efficiently with a simple structure.

Further, the lower end of the oil discharge passage 75 which is in communication with the oil discharge hole 74 is in communication with the inside of the crankcase 11 below the oil surface L in the inside of the crankcase 11. Accordingly, it is possible to prevent the backflow of the rich blowby gas containing the oil mist generated in the inside of the crankcase 11 from the oil discharge passage 75 to the breather chamber 60. At the same time, the oil separated by the breather chamber 60 can be ensured to be returned to the lower portion of the inside of the crankcase 11.

Although the embodiment of the present invention has been explained heretofore, the present invention is not limited to the above-mentioned embodiment and various design changes can be made without departing from the present invention described in claims.

For example, although the cam chain 51 is used as a driving force transmission member for transmitting the driving force from the crankshaft 18 to the camshaft in the above-mentioned embodiment, the present invention is also applicable to an overhead-valve internal combustion engine which uses a timing belt as the driving force transmission member.

As has been explained heretofore, according to the present invention, there is no possibility that the discharge of oil from the breather chamber is impeded by the blowby gas introduced into the breather chamber. Hence, it is possible to perform a smooth discharge of oil. Further, the concentration of the oil mist in the blowby gas introduced into the breather chamber is lowered. Hence, the vapor-liquid separation performance can be enhanced.

Further, according to the present invention, it is possible to prevent oil dwelling in the lower portion of the inside of the camshaft housing chamber from being introduced into the breather chamber through the breather inlet passage.

According to the present invention, the blowby gas which is introduced to the breather chamber from the breather inlet passage flows into the upper chamber from the lower chamber through the cylinder gasket. At the same time, the cylinder gasket has a vapor-liquid separation function. Accordingly, it is possible to enhance the vapor-liquid separation performance without using special members.

According to the present invention, it is possible to perform the vapor-liquid separation efficiently with a simple structure.

Further, according to the present invention, while preventing the backflow of the rich blowby gas containing the oil mist generated in the inside of the crankcase into the breather chamber from the oil discharge passage, it is also possible to ensure the return of the oil separated in the breather chamber to the lower portion of the inside of the crankcase.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A breather structure for an overhead-valve internal combustion engine in which a cylinder bore is formed in a cylinder block coupled to a crankcase which rotatably supports a crankshaft, a camshaft housing chamber which houses a camshaft for performing an open/close driving of an intake valve and an exhaust valve which are arranged in a cylinder head is formed between the cylinder head which is coupled to the cylinder block, a driving force transmission chamber which is arranged at the side of the cylinder bore is formed in the crankcase, the cylinder block and the cylinder head such that a driving force transmission member which transmits a rotational driving force of the crankshaft to the camshaft is housed in the driving force transmission chamber, and a breather chamber which is arranged below the camshaft housing chamber and at the side of the cylinder bore and the driving force transmission chamber is formed such that the breather chamber extends between the cylinder block and the crankcase comprising:

a breather inlet passage including an upper end thereof in communication with an inside of the camshaft housing chamber and a lower end thereof in communication with the breather chamber at a position corresponding to a mating face between the cylinder block and the crankcase is arranged in the cylinder block such that the breather inlet passage extends vertically; and an oil discharge hole being in communication with a lower portion of the inside of the breather chamber and arranged in the crankcase.

2. The breather structure of an overhead-valve internal combustion engine according to claim 1, wherein a projecting portion which projects upwardly from a lower face of the camshaft housing chamber is integrally formed on an upper portion of the cylinder block, and the upper end of the breather inlet passage opens at an upper end of the projecting portion.

3. The breather structure of an overhead-valve internal combustion engine according to claim 1, wherein a cylinder gasket for partitioning the breather chamber into a lower chamber at the crankcase side and an upper chamber at the cylinder block side, allows the flow of a blowby gas from the lower chamber to the upper chamber, and is capable of separating a vapor-liquid mixture from the blowby gas is inserted between the crankcase and the cylinder block, and a communication hole which allows a lower end of the breather inlet passage to communicate with the lower chamber is formed in the cylinder gasket.

4. The breather structure of an overhead-valve internal combustion engine according to claim 2, wherein a cylinder gasket for partitioning the breather chamber into a lower chamber at the crankcase side and an upper chamber at the cylinder block side, allows the flow of a blowby gas from the lower chamber to the upper chamber, and is capable of separating a vapor-liquid mixture from the blowby gas is inserted between the crankcase and the cylinder block, and a communication hole which allows a lower end of the breather inlet passage to communicate with the lower chamber is formed in the cylinder gasket.

5. The breather structure of an overhead-valve internal combustion engine according to claim 3, wherein a plurality of small holes for enabling the lower chamber and the upper chamber to communicate with each other are formed in the cylinder gasket.

6. The breather structure of an overhead-valve internal combustion engine according to claim 4, wherein a plurality of small holes for enabling the lower chamber and the upper chamber to communicate with each other are formed in the cylinder gasket.

7. The breather structure of an overhead-valve internal combustion engine according to claim 1, wherein an oil discharge passage for communicating with the oil discharge hole has a lower end thereof in communication with an inside of the crankcase below an oil surface in the inside of the crankcase.

8. The breather structure of an overhead-valve internal combustion engine according to claim 2, wherein an oil discharge passage for communicating with the oil discharge hole has a lower end thereof in communication with an inside of the crankcase below an oil surface in the inside of the crankcase.

9. The breather structure of an overhead-valve internal combustion engine according to claim 3, wherein an oil discharge passage for communicating with the oil discharge hole has a lower end thereof in communication with an inside of the crankcase below an oil surface in the inside of the crankcase.

10. The breather structure of an overhead-valve internal combustion engine according to claim 4, wherein an oil discharge passage for communicating with the oil discharge hole has a lower end thereof in communication with an inside of the crankcase below an oil surface in the inside of the crankcase.

11. The breather structure of an overhead-valve internal combustion engine according to claim 5, wherein an oil discharge passage for communicating with the oil discharge hole has a lower end thereof in communication with an inside of the crankcase below an oil surface in the inside of the crankcase.

12. The breather structure of an overhead-valve internal combustion engine according to claim 6, wherein an oil discharge passage for communicating with the oil discharge hole has a lower end thereof in communication with an inside of the crankcase below an oil surface in the inside of the crankcase.

13. A breather structure adapted to be used with an overhead-valve internal combustion engine in which a cylinder bore in a cylinder block comprising:

a breather chamber arranged below a camshaft housing chamber and at a side of the cylinder bore and a driving force transmission chamber, said breather chamber extending between the cylinder block and a crankcase;

a breather inlet passage including an upper end thereof in communication with an inside of a camshaft housing chamber and a lower end thereof in communication with the breather chamber at a position corresponding to a mating face between the cylinder block and the crankcase, said breather inlet passage being arranged in the cylinder block such that the breather inlet passage extends vertically; and an oil discharge hole being in communication with a lower portion of the inside of the breather chamber and arranged in the crankcase.

14. The breather structure adapted to be used with an overhead-valve internal combustion engine according to claim 13, wherein a projecting portion which projects upwardly from a lower face of the camshaft housing chamber is integrally formed on an upper portion of the cylinder block, and the upper end of the breather inlet passage opens at an upper end of the projecting portion.

15. The breather structure adapted to be used with an overhead-valve internal combustion engine according to claim 13, wherein a cylinder gasket for partitioning the breather chamber into a lower chamber at the crankcase side and an upper chamber at the cylinder block side, allows the flow of a blowby gas from the lower chamber to the upper chamber, and is capable of separating a vapor-liquid mixture from the blowby gas is inserted between the crankcase and the cylinder block, and a communication hole which allows a lower end of the breather inlet passage to communicate with the lower chamber is formed in the cylinder gasket.

16. The breather structure adapted to be used with an overhead-valve internal combustion engine according to claim 14, wherein a cylinder gasket for partitioning the breather chamber into a lower chamber at the crankcase side and an upper chamber at the cylinder block side, allows the flow of a blowby gas from the lower chamber to the upper chamber, and is capable of separating a vapor-liquid mixture from the blowby gas is inserted between the crankcase and the cylinder block, and a communication hole which allows a lower end of the breather inlet passage to communicate with the lower chamber is formed in the cylinder gasket.

17. The breather structure adapted to be used with an overhead-valve internal combustion engine according to claim 15, wherein a plurality of small holes for enabling the lower chamber and the upper chamber to communicate with each other are formed in the cylinder gasket.

18. The breather structure adapted to be used with an overhead-valve internal combustion engine according to claim 16, wherein a plurality of small holes for enabling the lower chamber and the upper chamber to communicate with each other are formed in the cylinder gasket.

19. The breather structure adapted to be used with an overhead-valve internal combustion engine according to claim 13, wherein an oil discharge passage for communicating with the oil discharge hole has a lower end thereof in communication with an inside of the crankcase below an oil surface in the inside of the crankcase.

20. The breather structure adapted to be used with an overhead-valve internal combustion engine according to claim 14, wherein an oil discharge passage for communicating with the oil discharge hole has a lower end thereof in communication with an inside of the crankcase below an oil surface in the inside of the crankcase.

* * * * *